United States Patent [19]

Smith

[11] 3,942,461

[45] Mar. 9, 1976

[54] SELF-STEERING DEVICE FOR SAIL BOATS

[76] Inventor: David A. Smith, 14928 La Cumbre Drive, Pacific Palisades, Calif. 90272

[22] Filed: Mar. 31, 1975

[21] Appl. No.: 563,348

[52] U.S. Cl. ..... 114/144 C
[51] Int. Cl.[2] ..... B63H 25/08
[58] Field of Search ..... 114/144 R, 144 C

[56] References Cited

UNITED STATES PATENTS

| | | | |
|---|---|---|---|
| 3,180,298 | 4/1965 | Gianoli | 114/144 C |
| 3,319,594 | 5/1967 | Gianoli | 114/144 C |
| 3,678,878 | 7/1972 | Ross-Clunis | 114/144 C |

*Primary Examiner*—Trygve M. Blix
*Assistant Examiner*—Gregory W. O'Connor
*Attorney, Agent, or Firm*—Flehr, Hohbach, Test, Albritton & Herbert

[57] ABSTRACT

A windvane powered, self-steering device for sail boats of the type employing a steering rudder and trim tab. The windvane pivots about an axis that is tiltably adjustable for light or heavy winds. The windvane axis is also rotatably adjustable with respect to the center line of the sail boat to provide course adjustment. When engaged for operation, the windvane senses the relative ship-wind direction and, when the ship is off course, translates the wind forces on the windvane into corrective movements of the trim tab and rudder to return the sail boat to course. In this operational or steering mode, the self-steering device is characterized by its ability to fully transmit wind power at all angles of tilt of the windvane axis, also, by its ability to be separately adjusted to any desired angle of tilt (wind sensitivity adjustment) or rotation (course adjustment). A preferred embodiment of the self-steering device includes means to initially employ the windvane in a trailing operation to establish a desired steering position for course (trailing mode) and thereafter to employ the windvane in a weathervaning operation for steering corrections (operational mode).

10 Claims, 13 Drawing Figures

FIG. 9
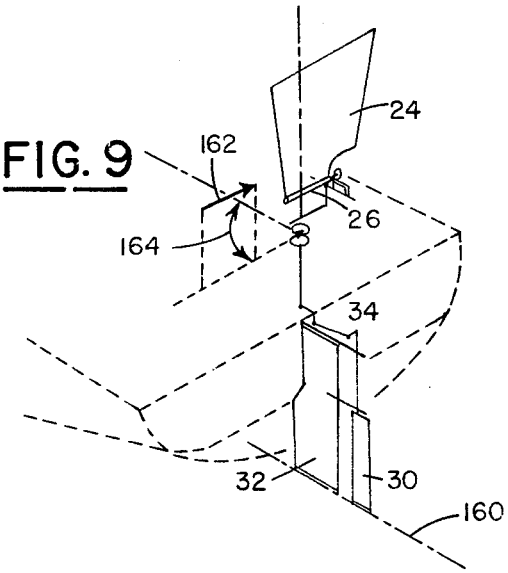
FIG. 10
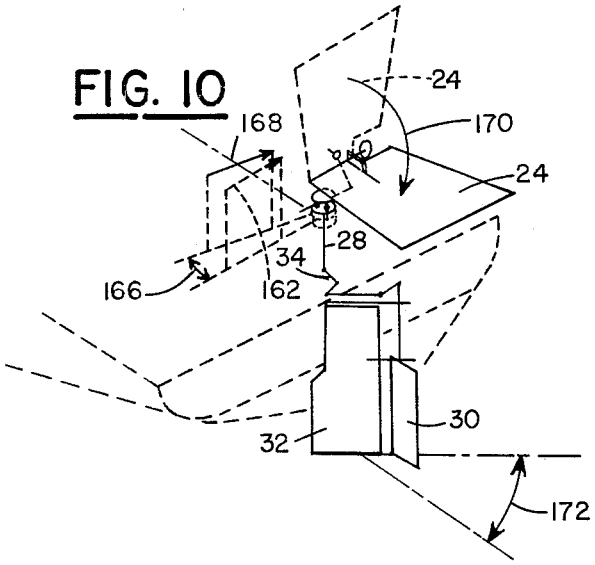
FIG. 11
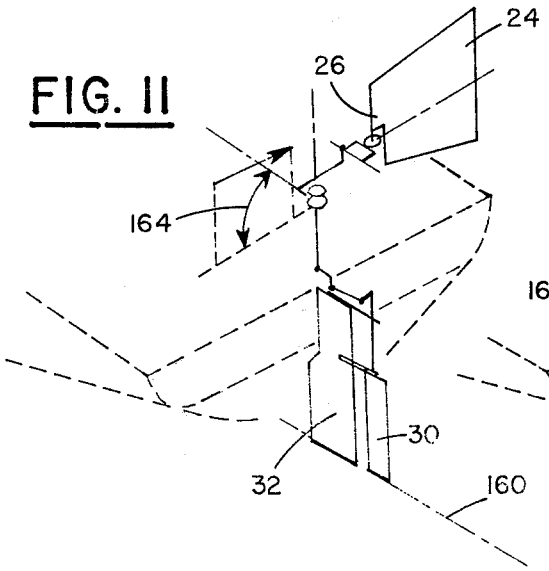
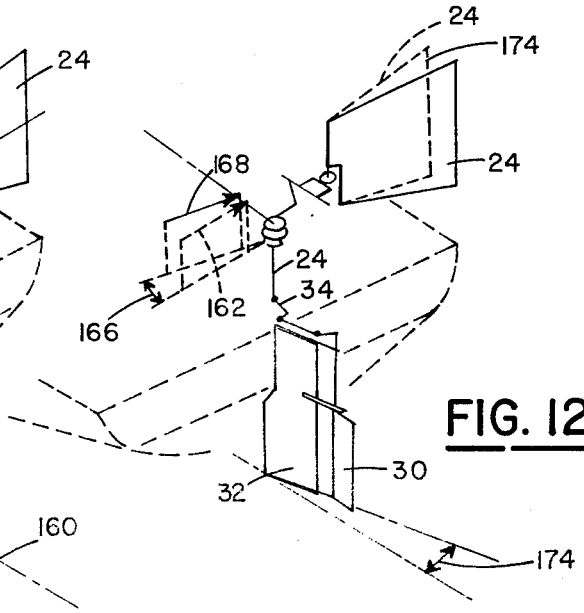
FIG. 12

| INITIAL SHIP HEADING | TRUE REFERENCE SYSTEM | SHIP REFERENCE SYSTEM | REACTION BETWEEN WINDVANE AND CONTROL UNIT | TRIM-TAB MOVEMENT | STEERING RUDDER MOVEMENT | STEERING CORRECTION | RESULT |
|---|---|---|---|---|---|---|---|
| WINDVANE AXIS HORIZONTAL | | | | | | | |
| ON DESIRED COURSE | | | VANE CONTROL UNIT WINDVANE TOP REAR | RUDDER TRIM TAB | WATER FLOW | NONE | NO CHANGE OF SHIP-WIND ANGLE |
| OFF COURSE TO STARBOARD | | | | | | TURN TO PORT | RETURN SHIP TO DESIRED SHIP-WIND ANGLE |
| OFF COURSE TO PORT | | | | | | TURN TO STARBOARD | RETURN SHIP TO DESIRED SHIP-WIND ANGLE |
| WINDVANE AXIS VERTICAL | | | | | | | |
| ON DESIRED COURSE ARBITRARY WIND-SHIP ANGLE | WIND SHIP | | TOP REAR | | | NONE | NO CHANGE OF SHIP-WIND ANGLE |
| OFF COURSE TO STARBOARD | | | | | | TURN TO PORT | RETURN SHIP TO DESIRED SHIP-WIND ANGLE |
| OFF COURSE TO PORT | | | | | | TURN TO STARBOARD | RETURN SHIP TO DESIRED SHIP-WIND ANGLE |

FIG. 13

SELF-STEERING DEVICE FOR SAIL BOATS

BACKGROUND OF THE INVENTION

As is well known to both the commercial and sport sailor, it is frequently desirable that a sail boat have the capacity to steer itself, thereby relieving the helmsman for other duties or rest. Such occasions might arise during lengthy ocean passages, when sailing with short-handed crew, or, particularly, when sailing single-handed. In all such circumstances, it is essential that the self-steering device have complete control of the helm to prevent undesired motions of the sail boat or deviations from a preset course.

Numerous efforts have been made to develop self-steering systems for sail boats, for the general purpose described as well as for other purposes. One category of such mechanisms, for example, has the purpose of maintaining a boat on a given course with a fixed compass heading. As mechanisms in this category generally require auxiliary power responsive to control by some compass device, they are of no interest to the present invention which is specifically directed to a wind powered device designed to hold the boat on a selected heading or course relative to the apparent wind direction. Another category of self-steering mechanisms has the limited purpose of providing direction to model yachts, and is likewise of no interest to the present invention because the self-steering arrangements for model yachts are not effective in performing the functions required for full-size boats.

In the particular category of self-steering mechanisms for sports sail boats, some fairly effective and reliable systems have been developed in the past decade for achieving self-steering relative to the apparent wind direction. Such systems generally employ a windvane to measure the apparent wind direction, and use the wind pressure on the windvane, when the ship wanders off course, to drive a steering device that will steer the ship back to the desired course. In such systems, the steering device can be the ship's tiller, an auxiliary rudder or trim tab, a servo blade for amplifying power, or like means, depending upon the particular system used. Self-steering mechanisms of this general type, wherein windvanes are employed to sense apparent wind direction, are disclosed in Gianoli U.S. Pat. Nos. 3,180,298 and 3,319,594, Ross-Clunis U.S. Pat. No. 3,678,878 and Saye U.S. Pat. No. 3,765,361.

Although effective to a degree, known self-steering mechanisms of the type described have not proved to be entirely satisfactory in use. Reasons for this result have been sought in theoretical and experimental studies. Thus, assuming that yaw or sway is of primary interest in determining the directional stability criterion for a sailing vessel (and that roll, pitch, surge or heave have a minimal effect), it can be determined that the stability criterion is a non-linear function of the forward speed of the vessel. Further, if it is assumed that there is a time lag between a wind powered input signal to the windvane, and the resulting corrective deflection of the rudder, it can be determined that the time lag in the self-steering system is dependent on the velocity of the water flowing over the auxiliary rudder (trim tab); also, that the time lag will be greatest when the water velocity is small. The conclusion, therefore, which has been verified by experimental work, is that a truly successful self-steering mechanism must yield an adjustable, non-linear response to the sensing of apparent wind. Upon analysis, it has been further determined that known self-steering systems are defective in the desired capacity of providing an adjustable, non-linear response for control of both the stability criterion and the time lag of the system, particularly in a simple, small, lightweight mechanism designed for use in sport sailing operations.

SUMMARY OF THE INVENTION

This invention relates generally to wind powered self-steering devices for sailing vessels, and more particularly to a vane type steering mechanism for sail boats wherein the vane senses apparent wind direction to maintain the vessel on desired course. It specifically relates to a wind powered self-steering mechanism for providing an adjustable, non-linear steering response under all conditions of sea and weather.

In general, it is an object of the present invention to provide an improved wind powered self-steering device for sail boats for the purpose described.

It is a particular object of the invention to provide a wind powered self-steering device for sail boats wherein use is made of a windvane which is tiltably adjustable for varying conditions of sea and wind, and which is operational to fully transmit wind power for steering corrections at all angles of tilt of the windvane axis.

It is another object of the invention to provide a wind powered self-steering device of such character wherein the windvane can be initially employed in a trailing operation to establish a desired steering or course position, and thereafter freed to operate in a weathervaning operation for steering corrections.

Still another object of the invention is to provide a wind powered self-steering device of such character wherein the windvane is separately adjustable in the operational mode to varying angles of tilt of the windvane pivot axis, to accommodate varying conditions of sea and weather.

A still further object of the invention is to provide a wind powered self-steering device of such character which can be separately adjusted in the operational or steering mode to rotate the windvane tilt axis to provide a desired course adjustment.

A still further object of the invention is to provide a wind powered self-steering device of such character which is relatively inexpensive and simple of construction, and which can be easily mounted or demounted on a sail boat.

As a brief statement of the invention, I provide a wind powered self-steering device which uses a windvane to positively translate substantially all of the wind forces produced by the sail boat being off course into corrective movements of the trim tab and rudder to return the sail boat to course. The device employs a base unit attached to the sail boat, and a vane unit mounted for pivotal movements about a vertical axis as respects the base unit. These units support the self-steering mechanism which functions generally to translate the windvane movements into linear movements of an output shaft, which linear movements are, in turn, translated into pivotal steering movements of the rudder trim tab.

More specifically, the vane unit includes a vane support mounted for pivotal movements about a horizontal axis, and which carries vane means mounted on a pivot axis which is perpendicular to the horizontal pivot axis of the vane support. The steering mechanism additionally includes means to pivot the vane support to obtain varying angles of tilt of the vane pivot axis between substantially vertical and horizontal positions, as may be needed for desired sensitivity to differing conditions of sea and weather. The steering mechanism particularly includes means which are fully operable at all angles of tilt of the vane pivot axis to translate the pivotal movements of the vane into linear movements of the output shaft, at a substantially constant ratio of linear response of the output shaft to the pivotal vane motion. In a preferred embodiment, the steering mechanism includes control means which are operable to position the vane means alternatively, in either a trailing or steering mode. In the trailing mode, the vane is prevented from pivoting but is free to rotate about the vertical pivot axis between the base and vane units, to sense the apparent wind direction for purposes of establishing a steering or course position. In the steering mode, the windvane is fixed to the course position but is free to pivot on its own axis to provide the above described steering function, when the sail boat wanders off course. The self-steering device additionally includes means to separately adjust the tilt angle of the windvane while in the steering mode, and also to separately adjust the windvane pivot support to obtain desired course corrections. These features generally permit the self-steering device to be operated in a trailing mode to sense apparent wind direction, until such time as it is desired to engage the device for the self-steering function. At this time, the course setting can be determined from the trailing position and the windvane engaged in the operational mode to provide necessary steering corrections to the trim tab and rudder, to maintain the sail boat on course with respect to the direction of the apparent wind. During such operations, the tilt axis of the windvane can be adjusted to accommodate variation in the sea and weather conditions, and course corrections can be introduced to the system without discontinuance of the steering function.

Other features and advantages of the invention will be apparent from the following description taken in conjunction with the drawings.

BRIEF DESCRIPTION OF THE DRAWINGS

FIG. 9 is a schematic illustration in perspective, showing the windvane axis in horizontal position and the vessel on course with respect to the apparent wind.

FIG. 10 is a view like FIG. 9 showing the action of the windvane when the vessel is off course to port.

FIG. 11 is a view like FIG. 9 showing the windvane axis in vertical position and the vessel on course with respect to apparent wind.

FIG. 12 is a view like FIG. 11 showing the action of the windvane when the vessel is off course to port.

FIG. 13 is a schematic illustration in chart form, illustrating the operations of the self-steering device of the invention when the windvane axis is substantially horizontal (relatively light winds) and when the windvane axis is substantially vertical (relatively stiff winds).

THEORETICAL CONSIDERATIONS

Figures 1, 2:
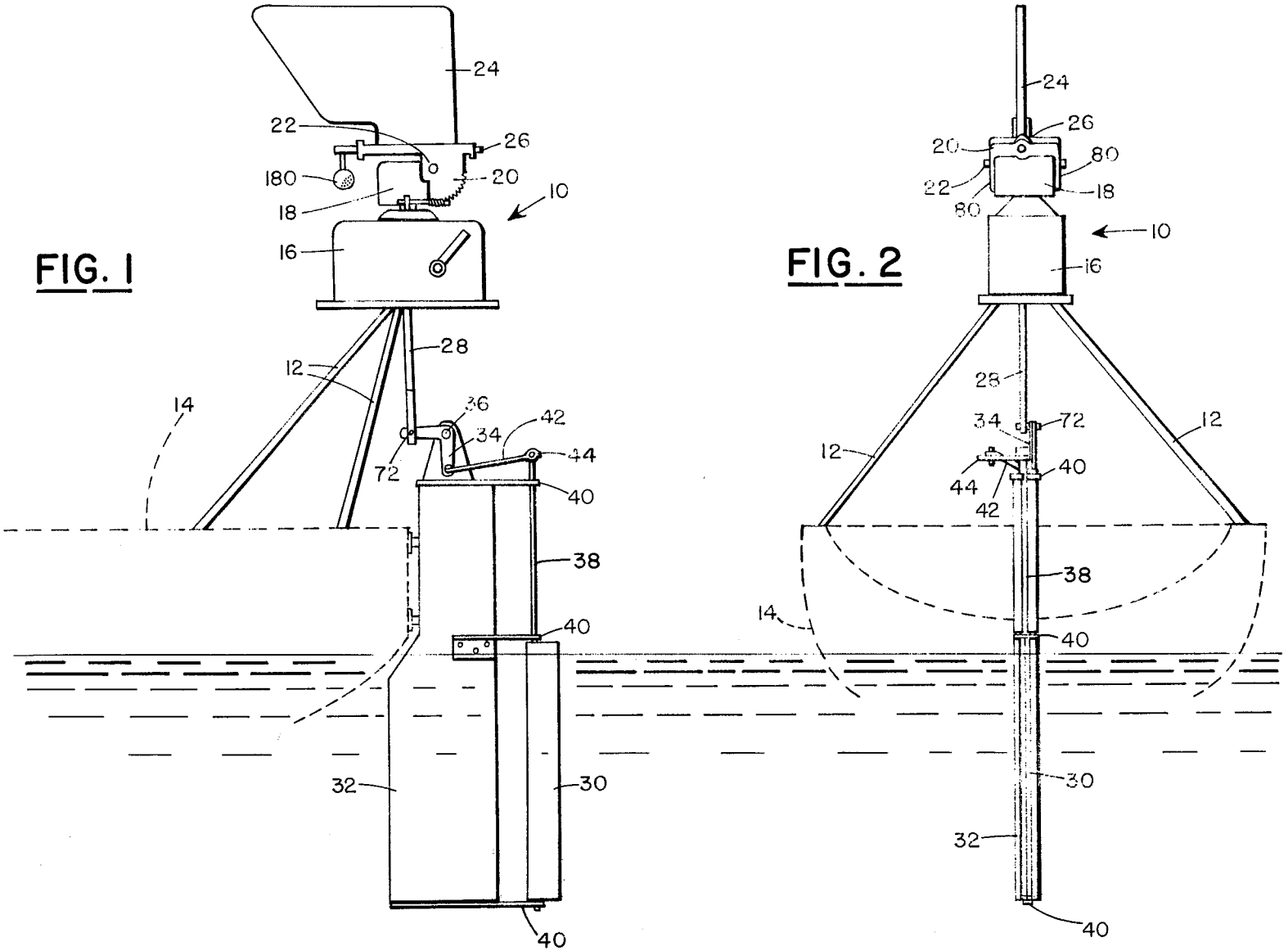
FIG. 1 is a side elevational view of an illustrative embodiment of the wind powered self-steering device of the present invention, showing it mounted on the stern of a sail boat.
FIG. 2 is a rear elevational view of the self-steering device shown in FIG. 1.

As postulated by Mandel[1], the motion of a body moving on the surface of a fluid can be presented in a set of six coupled non-linear differential equations. Since no closed solution exists for these equations, it is appropriate to make certain assumptions to facilitate a simplified solution. A basic assumption, that the perturbation motions are small, allows onee to express the motion parameters as a Taylor expansion of a function of several variables. By neglecting terms higher than first order, a set of six coupled linear differential equations can be produced. As solution of these equations is still made difficult by coupling terms, further simplifying assumptions can be made to decouple some of the equations.

[1]Mandel, P., *Principles of Naval Architecture*, Society of Naval Architects and Marine Engineers, New York, 1967.

In the context of the present invention, which relates to control of the steering of a sailing vessel, the equation for yaw is of primary interest. The equation for sway is also of importance. On the other hand, the equations for roll, pitch, surge and heave are of much less importance. Accordingly, to simplify the equations for motion of the sailing vessel, it may be assumed that roll, pitch, surge and heave have no effect on yaw or sway, and that only the two coupled equations for yaw and sway must be considered. Following the notation of Mandel, these equations are:

$$-Y_v V + (m - Y_{\dot{v}})\dot{V} - (Y_{\dot{\psi}} - mn_1)\dot{\psi} - (Y_{\ddot{\psi}} - mx_G)\ddot{\psi} = 0$$

and $$-N_v V - (N_{\dot{v}} - mx_G)\dot{V} - (N_{\dot{\psi}} - mx_G n_1)\dot{\psi} + (I_z - N_{\ddot{\psi}})\ddot{\psi} = 0$$

With reference to the foregoing equations, and to the following figure for nomenclature and sign convention,

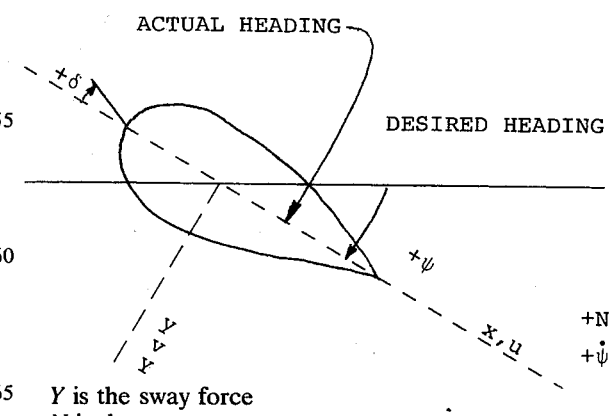

$Y$ is the sway force
$N$ is the yaw moment
$m$ is the mass of the ship
$x_G$ is the longitudinal position of the center of gravity $I_z$ is the moment of inertia about the Z axis
$u_l$ is the forward velocity
$v$ is the sway velocity
$\dot{\psi}$ is the yaw angular velocity $$Y_v = \frac{Y}{v}, \quad Y_{\dot{v}} = \frac{\delta Y}{\delta \dot{v}}, \quad Y_{\dot{\psi}} = \frac{\delta Y}{\delta \dot{\psi}}, \quad Y_{\ddot{\psi}} = \frac{\delta Y}{\delta \ddot{\psi}}$$

$$N_v = \frac{\delta N}{\delta v}, \quad N_{\dot{v}} = \frac{\delta N}{\delta \dot{v}}, \quad N_{\dot{\psi}} = \frac{\delta N}{\delta \dot{\psi}}, \quad N_{\ddot{\psi}} = \frac{\delta N}{\delta \ddot{\psi}}$$

In non-dimensional form these become $$-Y'_v V' + (m' - Y'_{\dot{v}})\dot{V}' - (Y'_{\dot{\psi}} - m')\dot{\psi}' - (Y'_{\ddot{\psi}} - m'x'_G)\ddot{\psi}' = 0$$

and $$-N'_v V' - (N'_{\dot{v}} - m'x'_G)\dot{V}' - (N'_{\dot{\psi}} - m'x'_G)\dot{\psi}' + (I'_z - N'_{\ddot{\psi}})\ddot{\psi}' = 0$$

where the primes denote non-dimensional quantities.

Assuming that the control surfaces induce external forces and moments, the equations are no longer homogeneous, and become $$-Y'_v V' + (m' - Y'_{\dot{v}})\dot{V}' - (Y'_{\dot{\psi}} - m')\dot{\psi}' - (Y'_{\ddot{\psi}} - m'x'_G)\ddot{\psi}' = Y'_\delta \delta$$

and $$-N'_v V' - (N'_{\dot{v}} - m'x'_G)\dot{V}' - (N'_{\dot{\psi}} - m'x'_G)\dot{\psi}' + (I_z' - N'_{\ddot{\psi}})\ddot{\psi}' = N'_\delta \delta$$

with $\delta$ equal to the rudder deflection angle.

Since the windvane measures the ship-wind angle, it is measuring the quantity $\psi$ in the above equations.

If we assume proportional control of the rudder, then, $$\delta(t) = \kappa_1 \psi(t)$$

where $\kappa_1$ is a positive speed dependent coefficient produced by the automatic steering mechanism.

Further, if we assume that the automatic control system has a time lag between input signal, $\psi$, and desired deflection of the rudder, then the rudder deflection is given by $$\delta(t) = \kappa_1 \psi(t - \bar{t})$$

where $\bar{t}$ is the time lag of the system.

The non-dimensional equations of motion now become, $$Y'_v V' + (Y'_{\dot{v}} - m')\dot{V}' + K_1 Y'_\delta \psi + (Y'_{\dot{\psi}} - m'x'_G)\ddot{\psi}' = 0$$

and $$N'_v V' + (N'_{\dot{v}} - m'x'_G)\dot{V}' + K_1 N'_\delta \psi + (N'_{\dot{\psi}} - m'x'_G)\dot{\psi}' + (N'_{\ddot{\psi}} - I'_z)\ddot{\psi}' = 0$$

As noted by Mandel, the criterion for a directionally stable ship obeying the above equations is that, $$Y'_v(N_{\dot{\psi}}' - m'x'_G - K_1 \bar{t}' N'\delta) - N'_v(Y'_{\dot{\psi}} - m' - K_1 \bar{t}' Y'_\delta) > 0$$

This quantity is the one to be particularly examined.

Moreover, the quantities $Y'_v$, $N_\psi'$, $N'_\delta$, $N_v'$, $Y'_\psi$ and $Y'_\delta$ are, in general, non-linear and dependent on the forward speed of the vessel. Thus the stability criterion is a non-linear function of forward speed.

As respects the automatic self-steering device of the present invention, the time lag is dependent on the velocity of the water flowing over the trim tab, the time lag being largest for low water velocities.

In general, and on the foregoing analysis, it may be concluded that the proportionality coefficient, $K_1$, must be such that it yields an adjustable non-linear response to the automatic control mechanism. Translated into performance characteristics for a wind powered self-steering device for sail boats, the response of the self-steering mechanism must be both adjustable and non-linear to accommodate varying forward speeds of the vessel and varying conditions of wind and sea. The self-steering device of the present invention is designed to provide these features and also to provide operational simplifications not found in existing wind powered, self-steering mechanisms. As hereinafter noted, particular operational simplifications include an engage-disengage lever, a trailing function for the windvane when disengaged, a sensitivity adjustment for the windvane when engaged and operational (to accommodate variations in forward speed of the vessel and wind and sea), and a fine course adjustment for the windvane in either mode of operation — all capable of being controlled from the cockpit of the sailing vessel.

DESCRIPTION OF THE PREFERRED EMBODIMENT

Referring to FIG. 1, reference numeral 10 generally represents a wind powered self-steering device in accordance with the invention, mounted by appropriate detachable support brackets 12 on the stern of a sail boat 14. As illustrated, the device 10 comprises a base unit 16 carried by the support brackets, a vane unit 18 mounted for pivotal movements about a vertical axis as respects the base unit 16, a vane support 20 mounted for pivotal movement about a horizontal pivot axis 22 as respects the vane unit, and a windvane 24 carried by the vane support and mounted on a pivot axis 26 which is perpendicular to the pivot axis 22 of the vane support. As further illustrated in FIG. 1, an output shaft 28 is mounted for linear movements in a generally vertical direction as respects the base unit 16 and vane unit 18. As hereinafter described in detail, the internal mechanism of the self-steering device 10 functions generally to translate pivotal movements of the windvane 24 about its pivot axis 26 into linear movements of the output shaft 28. The linear motion of the output shaft is then translated into pivotal movements of a trim tab 30 for the steering rudder 32 by means of a bell crank 34 pivoted on the steering rudder at 36. Thus as particularly shown in FIGS. 1 and 2, the trim tab 30 is supported for pivotal movements on rod 38 carried in brackets 40 extending rearwardly from the steering rudder 32, and is pivotally responsive to movements of the bell crank 34 through action of the connecting rod 42 and fixed lever arm 44.

It is a feature of the present invention that the windvane axis 26 can be adjusted to varying angles of tilt between substantially vertical and horizontal positions as respects the base unit 16, and, further, that pivotal movements of the windvane 24 are translated to linear movements of the output shaft 28 at a substantially constant ratio of linear response to the pivotal motion, regardless of the angle of tilt of the windvane axis. The apparatus for accomplishing this result is particularly illustrated in FIGS. 3 and 5 and includes cooperating mechanisms responsive to pivotal movements of the windvane, and carried on the windvane pivot axis 26, on the vane support 20, in the vane unit 18 and in the base unit 16. Thus, as particularly shown in FIG. 3, a pinion gear 46 is mounted on the vane pivot axis 26 so as to continuously engage a rack gear 48 slidably mounted on the pivot axis 22 for the vane support 20. As will be further apparent from FIG. 5, this arrangement insures that the pivotal movements of the wind vane 24 will be fully translated into linear sliding movements of the rack gear 48 at all angles of tilt of the windvane axis 26. Referring again to FIG. 3, the linear transverse movements of the rack gear 48 are translated into linear movements of the output shaft 28 by means of crank arms and cam followers carried by support shafts 50, which are rotatably mounted within the vane unit 18. More specifically, upright crank arms 52 carry cam follower ball bearings 54 which are received between fixed camming means 56 provided at either end of the rack gear 48, and mounted to slide therewith on shaft 22. In like fashion, a transverse crank arm 58 carries a cam follower ball bearing 60 which is received between fixed camming means 62 on the vertically movable output shaft 28.

Slide mounts for the pivot shaft 22, as generally represented at 64, can be provided in the sides of the vane unit 18. Cross brackets 66 and 68 within the vane and base units (see FIG. 3), are similarly provided with means 70 providing a slide mount for the output shaft 28. It will be appreciated that this arrangement permits rotary movements of the pinion gear 46, caused by steering pivotal movements of the windvane 24, to be translated into linear movements of the rack gear 48 and its shaft 22, which motion is translated by the crank arms and cam followers 52, 54 and 58, 56, into linear movements of the output shaft 28. Rotary or pivotal movements of the windvane 24 are thus ultimately translated to linear motion of the output shaft 28. Moreover, as will be apparent from FIGS. 3 and 5, this function is positively accomplished at all tilt angles of the windvane axis 26, with a substantially constant ratio of linear response of the output shaft 28 to the pivotal movements of the windvane 24.

As illustrated in FIGS. 1 and 2, the mechanical linkage between the output shaft and the trim tab 30 also insures that the linear motion of the output shaft is fully translated into rotary or pivotal movements of the trim tab 30. Thus, the slide mounts 70 for the output shaft permit rotation of the output shaft to accommodate pivotal movements of the bell crank 34 as the latter moves with the steering rudder 32. The output shaft may also include an intermediate universal connection, as represented at 71, to accommodate movements in the shaft 28 caused by rudder movements or flexing of the supports 12. As particuarly shown in FIG. 2, vertical movements of the output shaft 28 are transmitted to the upper arm of the bell crank by means of the cross link or pin 72. This pin also serves to rotate the output shaft 28 to accommodate the pivotal movements of the rudder and to insure effective transmittal of the windvane pivotal movements to the trim tab 30.

During periods of operation of the self-steering device 10, it can be expected that ship velocity, wind velocity and sea conditions will vary considerably. It is therefore necessary to have some form of sensitivity adjustment so that the device will perform equally well with any forward velocity, in both light and heavy wind conditions.

In accordance with the invention, the sensitivity of the device is adjusted by tilting the windvane pivot axis 26 to an optimum angle of tilt (between substantially horizontal or vertical angles of inclination) depending on the particular conditions encountered. Thus, a substantially vertical position of the vane pivot axis 26 is used in heavy winds where it is not advantageous to transmit all of the wind forces acting on the windvane 24 to the trim tab 30. In contrast, since there is relatively little wind force on the vane 24 during light wind conditions, a substantially horizontal position of the windvane axis 26 is used, to insure that the pivotal movements of the windvane and trim tab are sufficiently large to effectively shift the steering rudder. It will be appreciated that in the latter position, a relatively small error in course will produce a relatively large rotation of the windvane and trim tab, and thereby provide a maximum degree of power or work to move the steering rudder. For conditions between the extremes of heavy or light winds, an intermediate tilt angle of the windvane pivot axis 26 can be used, as hereinafter described.

Figures 3, 4:
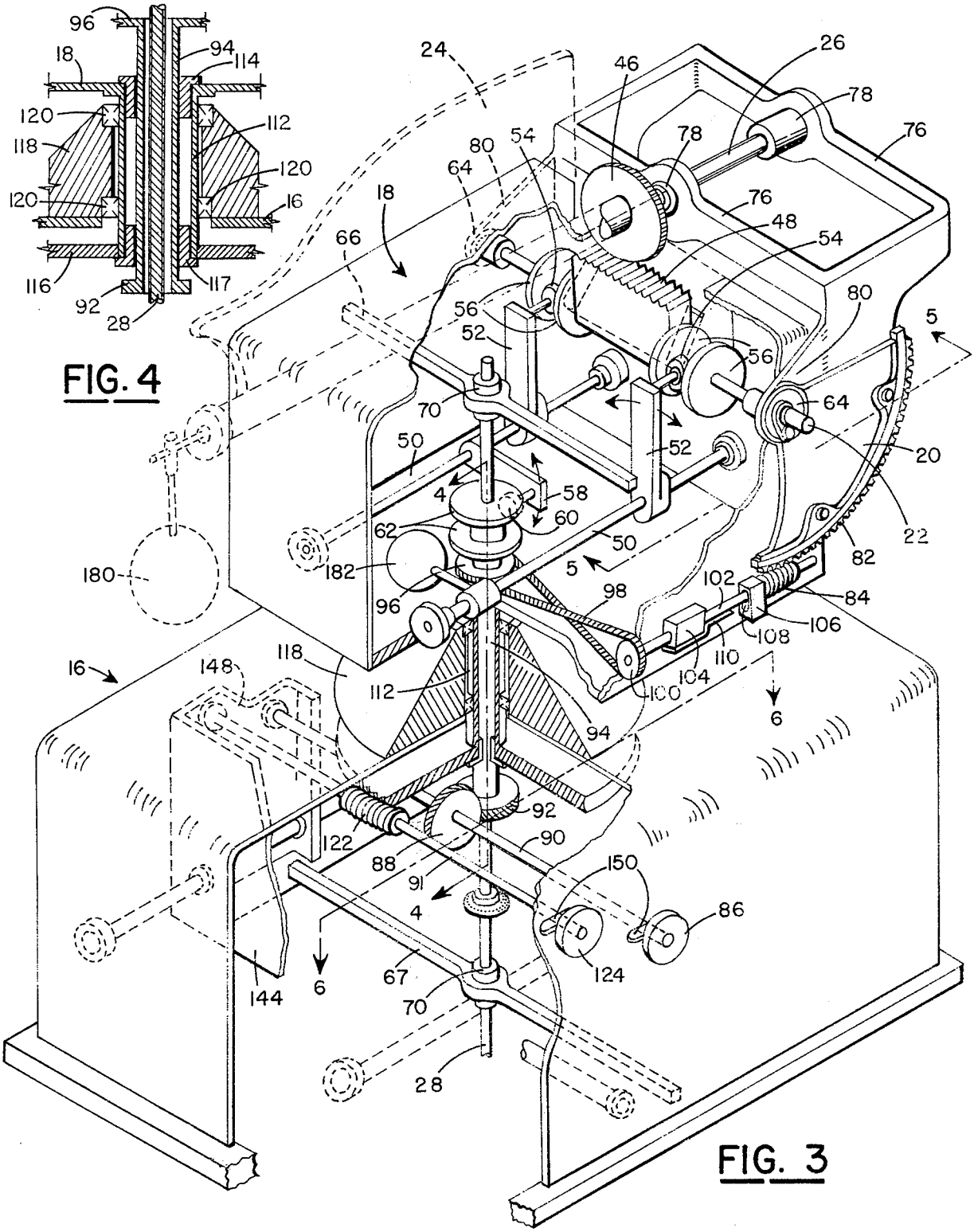
FIG. 3 is an enlarged perspective view, partially broken away, showing various details of the self-steering device as illustrated in FIGS. 1 and 2.
FIG. 4 is a view in section, with parts broken away, along the line 4—4 of FIG. 3.
Figure 5:
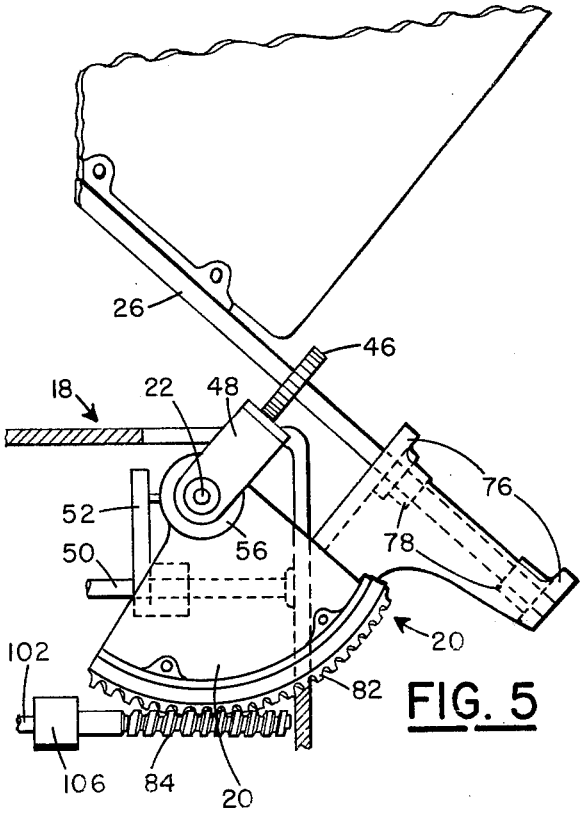
FIG. 5 is a view partly in section and partly side elevation, generally along the line 5—5 of FIG. 3, showing a different tilt position of the vane mechanism.

The means for tilting the windvane axis to obtain the desired sensitivity of the self-steering device is particularly illustrated in FIGS. 3 and 5, and also FIGS. 1 and 2. As previously noted, the windvane 24 is carried by the vane support member 20 which is mounted for pivotal movements with respect to the vane unit 18 by means of the horizontal pivot shaft 22. As particularly illustrated in FIG. 3, the vane support 20 includes transverse members 76 which support spaced bearing mounts 78 for the vane pivot shaft 26. The vane support 20 also includes spaced pivot arms 80 carried on the transverse shaft 22, and which enable pivoting of the vane support and vane axis 26 to a desired tilt angle. A segment gear 82 secured to one of the pivot arms 80 permits adjustment of the tilt angle, by suitable means such as the worm gear 84, which may also serve to lock or hold the vane support at the desired angle of tilt of the vane pivot axis.

As particularly shown in FIGS. 3 and 4, the illustrated worm gear 84 can be rotated by means of a suitable control knob 86 to obtain the desired sensitivity adjustment. Thus, rotation of the knob 86 can cause the helical gear 88 carried by the cross shaft 90 to rotate the adjacent helical gear 92 mounted on the hollow shaft 94, when these two gears are engaged. At its upper end, the shaft 94 is equipped with a pulley 96 which can function through belt 98 to rotate a pully 100 for the worm gear shaft 102. The latter is suitably mounted in bearing supports 104 and 106 carried externally of the vane unit 18. It will be appreciated that, when engaged, rotation of the sensitivity adjust knob 86 will cause rotation of the worm gear 84 to adjust the tilt angle of the segment gear 82 and, thereby, the tilt angle of the vane pivot axis 26.

To facilitate gross adjustments of the vane support member 20 (to provide major changes in the tilt angle of the vane pivot axis), the bearing 106 for the worm gear shaft 102 can be slotted, as at 108, to permit a slight downward pivotal movement of the shaft 102 and bearing support 104. This will free the segment gear 82 from the worm gear and permit the vane support member to be pivoted about the axis 22 to any desired tilt angle. Suitable springs means 110 can be provided to normally bias the worm gear 84 into contact with the segment gear 82, to hold the latter in a fixed or locked position.

Referring again to FIG. 4, it will be seen that the vane unit 18 is mounted for rotatable movement about a vertical axis as respects the base unit 16 in such fashion that the output shaft 28 is substantially coincident with the vertical axis of rotation. Thus, the base of the vane unit is fixed to the hollow shaft 94 and an outer sleeve 112 by means of a bushing 114. Likewise, for a purpose hereinafter described, a course adjustment gear 116 is fixed to the shaft 94 and sleeve 112 by a lower bushing 117. The hollow shaft 94 and sleeve 112 are rotatably positioned within a tapered spacing member 118 mounted on the top wall of the base unit 16. Spacing member 118 is suitably provided with ball bearings or like means 120 which facilitate free rotational movement of the vane unit and course adjustment gear 116 with respect to the base unit 16. At the same time, the output shaft 28 is free to move vertically within the hollow shaft 94 to transmit pivotal movements of the windvane 24 to the steering rudder trim tab 30. It may be further noted that the hollow shaft 94 is free to rotate within the bushings 114 and 117 so that sensitivity adjustments by means of the worm gear 84 and control 86 can be accomplished separately from course adjustments, carried out with the course adjustment gear 116. In this regard, as hereinafter described in detail, course adjustments wherein the vane unit 18 with respect to the base unit are accomplished through the gear 116, by means of a worm gear 122 which is operated through a control knob 124 (see FIG. 3).

In the illustrated embodiment of the invention, an engage-disengage type of control means is provided to initially establish a steering or course position of the windvane 24 and, thereafter, to engage the windvane to transmit steering corrections to the trim tab 30 to maintain the vessel on desired course as respects the direction of the apparent wind. More specifically, the control means operates alternatively: in a first position to lock the output shaft 28 and the windvane 24, in an upright position of the latter, while freeing the vane and vane unit for trailing pivotal movements with respect to the sail boat (to thereby establish a desired steering position in response to the direction of the apparent wind), and: in a second position, to free the windvane 24 and output shaft 28 for steering pivotal movements, while maintaining the steering position of the vane unit 18 with respect to the sail boat. In the illustrated embodiment of the steering device 10, the apparatus for accomplishing this purpose is particularly shown in FIGS. 3 and 6 through 8.

The means to lock the windvane 24 in upright or trailing position comprises a slide mechanism 126, which may be mounted for sliding movements within the vane unit 18 on cross shafts 128. For this purpose, the slide mount 126 is provided with spaced bearing apertures 130 (see FIG. 6) which permit the slide mount to move between a disengaged position (FIGS. 6 and 7) and an engaged position (FIG. 8). In the latter position, engagement members 132 provided with wedge shaped surfaces 134, engage a fixed bushing 136 on the output shaft to vertically position the same to hold the vane unit 24 in a locked upright position. Conversely, in the disengaged position, the members 132 are retracted to permit free vertical movements of the output shaft 28 in response to steering pivotal movement of the windvane 24.

A lever 138 mounted on the outside of the vane unit 18 operates to advance or retract the slide mechanism 126 by means of a simple mechanical linkage including a coupled lever 140 mounted within the vane unit 18 and a connecting link member 142 pivotally mounted at one end on the internal lever 140 and at the other end on the slide member 126. As will be apparent from the drawings, pivoting of the control lever 138 towards the outside of the vane unit casing 18 (FIG. 8) will cause the slide member to engage the bushing 136 to restrain vertical movements of the output shaft 28, whereas pivoting the lever 138 towards the middle of the vane unit casing (FIG. 7) will cause the slide member to retract to free the output shaft 28.

Figure 6:
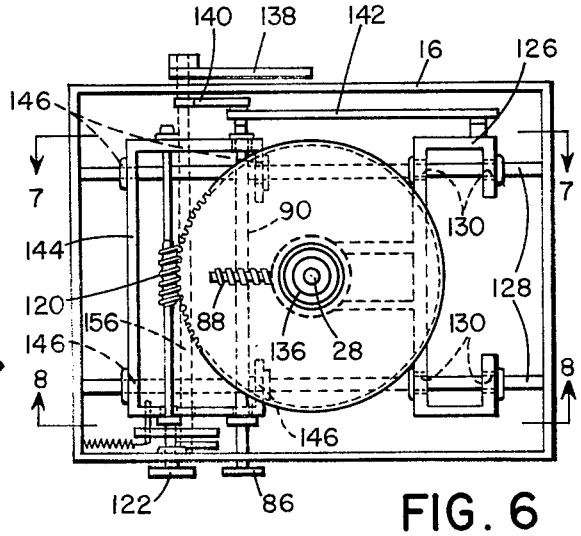
FIG. 6 is a detailed view in horizontal section along the line 6—6 of FIG. 3.

Means in the form of a slide member 144 is similarly provided to engage or disengage the gearing 88 and 120, respectively, for initiating sensitivity and course adjustments. As illustrated in FIG. 6, the slide member 144 is provided with a spaced bearing aperture 146 which permits the slide mount to move between an engaged position (FIG. 7) and a disengaged position (FIG. 8) as respects the gears 92 and 116. As best illustrated in FIGS. 3 and 6, the operating shafts for the gears 88 and 120 are rotatably mounted in side wall portions 148 of the slide member, and have protruding ends which pass through slotted openings 150 in the side wall of the base unit casing 16 (see FIG. 3). These slotted openings permit the control knobs 86, 124 and their supporting shafts 90, 91 to move as necessary to facilitate engaged and disengaged positions of the gears.

Figure 7:
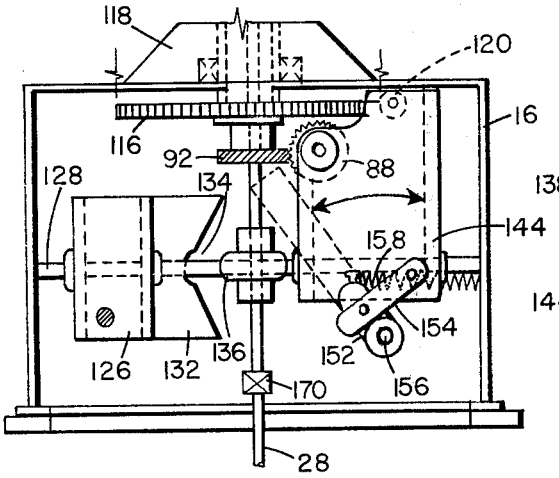
FIG. 7 is a like view in vertical section along the line 7—7 of FIG. 6.
Figure 8:
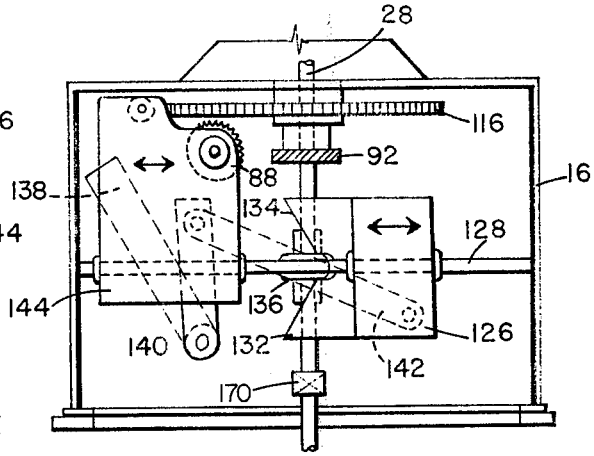
FIG. 8 is a like view along the line 8—8 of FIG. 6.

As shown in FIGS. 6 and 7, the engage and retract movements of the slide mount 144 are accomplished by a relatively short internal lever 152, and a link member 154 pivoted at one end on the lever 152 and at the other end on the slide mount 144. As shown in FIG. 6, the internal levers 140 and 152 are both mounted upon a cross shaft 156 to pivot unison with the external operating lever 138. In the illustrated apparatus, biasing means such as an internal spring 158 is provided to normally position the control levers 138, 140 and 152 in such position that the slide mechanism 126 is engaged to lock the output shaft 28 in fixed position, and the slide member 144 is disengaged to prevent operation of the gearing 88 and 120 for the sensitivity and course adjustment.

From the foregoing, it will be appreciated that the lever 138 provides for alternate operation of the slide mechanisms 126 and 144. That is, in the position of the lever 138 illustrated in FIG. 8, the slide mechanism 126 is engaged with the output shaft to lock the vane 24 in upright position, and the slide mechanism for the gearing 88 and 120 is disengaged so that the vane 24 is free to trail in the wind. Alternatively, in the position of the lever 138 in FIGS. 6 and 7, the reverse is true: the slide mechanism 126 is retracted to free the windvane for steering operations, and the slide mechanism 144 is advanced to engage the gearing 88 and 120 to permit tilt or sensitivity adjustments of the vane pivot axis 26 and also course adjustments through the gear 116. The latter adjustments are therefore available during the self-steering or operating phase of the self-steering device 10.

With reference to a disengaged or trailing position of the self-steering device 10, the output shaft 28 is locked in a vertical position such that the trim tab 30 is on the center line of the rudder 32, and the rudder is free to trail in the water flow. Such positioning of the parts is shown in FIGS. 1, 2 and 8. As previously noted, the windvane 24 is also locked against pivotal movement, in an upright position as respects the vane control units 16 and 18. Upon operating the lever 138 to retract the control gearing 88 and 120, the vane unit 18 (and, specifically, the gears 92 and 116) is free to rotate about a vertical axis as respects the base unit 16, permitting the windvane 24 to function as a weathervane to sense the direction of the apparent wind. This may be described as the "trailing mode" of the self-steering device 10, in which any wind force on the vane 24 will cause the vane to trail away from the apparent wind. The described relationship is generally represented in FIG. 9 where, to accommodate relatively light wind conditions, the windvane pivot axis 26 is positioned in a substantially horizontal position. It is also represented in FIG. 11, for relatively stiff wind conditions, with the windvane pivot axis in a substantially vertical position. Thus, assuming that the sailing vessel is proceeding on course, that is, substantially along its center line 160, the windvane 24 will assume a trailing position reflecting the direction of the apparent wind, as represented by the arrow 162. In this circumstance, the angle between the apparent wind direction and the course or intended direction of movement of the sailing vessel is represented by the angle 164. This angle is, of course, arbitrary, depending upon the desired direction of the ship with respect to the wind, and can be hereinafter referred to as the wind-ship angle. So long as the self-steering device is in the disengaged or trailing mode (FIG. 7), there will be no motion of the output shaft 28 since it is locked in fixed vertical position by the slide mechanism 126. Accordingly, if the wind-ship direction changes, the windvane 24 and vane unit 18 will rotate with respect to the base unit 16 to permit the windvane 24 to trail away from the apparent wind.

In the trailing mode as just described, the course adjustment gear 116 will also rotate with the windvane 24, and will therefore be in position to establish the desired course relation between the vane unit 18 and the base unit 16 at such time as it is elected to engage the self-steering device 10 to control the steering operations. There is consequently no need for further adjustments to establish the desired wind-ship angle since the windvane 24 will effectively assume the desired angle as it trails into the apparent wind, in the disengaged position of the system.

It should be further appreciated that the trailing positions of FIGS. 9 and 11 are representative only of the extreme tilt angle positions, and that the windvane 24 will similarly trail into the wind at any intermediate tilt angle of the pivot axis 26, representing weather and sea conditions between the two extremes desribed. Thus, prior to engaging the self-steering device 10 for self-steering operations, the tilt angle of the pivot axis can be adjusted by rotation of the control knob 86 to move the segment gear 82 with respect to the worm gear 84 or, alternatively, by depressing the worm gear 84 and manually repositioning the rack gear 82 with respect to the worm gear 84. This adjustment for sensitivity of the steering system will normally be made on the basis of prior experience as to the most effective tilt angle for the windvane 24 in relation to existing ship velocity, wind velocity, and conditions of sea and weather. As a practical matter, this sensitivity adjustment is most easily made when the windvane is locked in the relatively stable upright position employed for the "trailing" mode of operation.

Assuming that desired wind-ship and tilt angles of the windvane 24 have been established in the manner just described, the self-steering mechanism is engaged by rotating the operating lever 138 from the disengaged position of FIG. 8 to the engaged position of FIG. 7, advancing the slide mechanism 144 to the engaged position and retracting the slide mechanism 126. The effect of thus engaging the self-steering mechanism is twofold. First, the angular position of vane unit 18 is fixed with reference to its common vertical axis with the base unit 16, by interaction of the worm gear 120 with the course adjustment gear 116. Stated in another way, the trailing position of the windvane 24 with respect to the center line of the vessel, as represented for example in either FIG. 9 or 11, becomes fixed. Second, the output shaft 28 is unlocked so that the windvane 24 is free to pivot about its pivot axis 26 in response to wind forces produced by changes in the wind-ship angle from the desired or steering angle. Thus, as represented in FIGS. 10 or 12, it may be assumed that the ship has wandered off-course to port by an amount generally represented by the angle 166. The initial effect will be a change in the apparent wind direction from the original dotted line direction of arrow 162 (see FIGS. 9 and 11) to a new direction as represented by the arrows 168. Assuming the light wind conditions of FIG. 9 (and that the windvane axis 26 is substantially horizontal), the new direction of the apparent wind will cause a relatively large angular deflection of the windvane 24 (i.e., from the dotted line position to the full line position, as represented by the arrow 170 in FIG. 10). The net effect is to move the output shaft 28 upward to pivot the bell crank 34 so that the trim tab 30 is pivoted sharply to port, for a steering correction. In this condition, the force of water moving against the surface of the trim tab 30 will cause an equally large deflection of the steering rudder 32, as represented by the angle 172 in FIG. 10, to steer the ship back to the desired course.

A similar but somewhat less dramatic result will occur in the relatively heavy wind conditions of FIGS. 11 and 12. Thus, assuming that the ship wanders off course the same angular distance to port, as represented by the angle 166, the new apparent wind direction 168 will cause a substantially smaller deflection of the windvane 24, as represented by the angle 174. However, in this circumstance, the wind force is relatively greater so that a less sensitive response is required from the steering system. The net effect is again to move the output shaft upward so that the bell crank 34 achieves a relatively smaller steering correction of the trim tab 30. The deflection of the steering rudder 32, as represented by the angle 176, is likewise of less magnitude but is sufficient in the described conditions of wind and sea to quickly return the ship to the desired course.

The foregoing self-steering relationships, and the operation of the self-steering device 10 of the present invention, will be more fully understood by reference to the schematic representations shown in chart form in FIG. 13. Thus the top portion of the chart represents the situation where the windvane pivot axis 26 is substantially horizontal, as in the schematic representations of FIGS. 9 and 10, with the first horizontal column in the chart generally corresponding to FIG. 9 and the third horizontal column corresponding to FIG. 10. The middle column represents a circumstance similar to FIG. 10 wherein the ship wanders off course to starboard. In each case, the chart shows (from left to right) the true wind-ship relationship, the apparent wind-ship relationship, and the movement of the windvane 24 as seen from the top and rear of the windvane control unit. The chart also shows the initial trim tab movement and the resulting movement of the steering rudder to effect the course correction. Finally, the chart shows the function of the steering correction and the result ultimately accomplished. The bottom half of the chart similarly presents a schematic representation corresponding generally to a vertical positioning of the windvane pivot axis, as in the schematic representation of FIGS. 11 and 12. Again, FIG. 11 corresponds to the first horizontal column in this group, whereas FIG. 12 corresponds to the third horizontal column. The other chart relationships are as previously described.

In terms of the mechanical response of the self-steering mechanism, viz., when the ship goes off course and the wind-ship direction changes: the wind force supplied to the windvane 24 is translated to rotary motion of the pinion gear 48 on the windvane shaft 26. This occurs at all tilt angles of the windvane axis 26, whether horizontal, vertical or in an intermediate position as represented in FIG. 5. The rotary motion of the pinion gear 46 is immediately translated into linear motion of the rack gear 48 and its shaft 22. The crank arms 52, 58 and cam followers 54, 60 then transfer the linear motion of the rack gear to linear motion of the output shaft 28. In this fashion, the rotary or pivotal motion of the windvane 24 is rapidly translated to linear motion of the output shaft 28 which, in turn, is translated to pivotal motion of the trim tab 30, as generally represented in the several schematic representations of FIGS. 10, 12 and 13. Upon pivoting of the trim tab 30 in the manner indicated, the force and moment generated by the flow of water over the trim tab produces an opposite deflection of the steering rudder 32, which effectively steers the ship back to the desired course. Moreover, the foregoing operations will produce a substantially uniform response of the trim tab 30 to the pivotal motion of the windvane 20, at any and all angles of tilt of the vane pivot axis 26. This makes it possible to adjust the tilt angle or "sensitivity" of the self-steering device to accommodate varying conditions of ship velocity, wind velocity and conditions of sea or weather, to provide an optimum response for virtually any condition encountered. The vertical position of the windvane axis 26, shown in FIGS. 11 and 12, is used in heavy winds where it is not desired to transmit all of the large forces on the windvane 24 to the trim tab 30. In contrast, in very light wind conditions, where relatively little wind force can be applied to the windvane 24 to move the steering rudder 32, a substantial amplification of the available wind force is achieved by the horizontal position of the windvane axis. In this condition, a relatively small error in course will produce a relatively large rotation of the windvane 24 (as represented in FIG. 10), to thereby yield the maximum work for steering correction. For conditions between these extremes, an intermediate position of the windvane shaft axis is used. Such adjustments in the tilt angle of the windvane axis 26 can be achieved by means of the sensitivity adjust control 86, or by depressing the spring loaded worm gear shaft 102 in the manner previously described.

If it is desired to make a course change, involving a change in the wind-ship angle of the vane unit 18 with respect to the base unit 16, the course adjust control 122 can be rotated to cause the worm gear 120 to rotate the course adjust gear 116. This operation will rotate the vane unit 18 with respect to the base unit 16, and such rotation will alter the course steered by the self-steering device 10. In one embodiment of the invention, one revolution of the control knob 122 will cause an approximately 5° relative rotation of the vane unit with respect to the base unit 16. It is therefore possible to alter the relative course within a full range from 0° to 360°, or more. It will be appreciated, however, that this adjustment can only be made when the self-steering device is in the operating mode, as in FIGS. 3, 6 and 8 since, in such position, the worm gear 120 is engaged with the course adjustment gear 116. In the disengaged position, represented in FIG. 8, course adjustments are neither possible nor appropriate since, in such condition, it is desired that the windvane 24 and vane unit 18 be free to pivot in the "trailing" mode, to establish a desired wind-ship angle for self-steering operations.

From the foregoing, it will be apparent that the present invention provides an improved wind powered self-steering device for sailing vessels which provides many advantages as respects previous devices for the same or similar purpose. Specifically, it provides an adjustable non-linear steering response, which can be easily accommodated to varying conditions of wind, sea and ship velocity. The device particularly provides a wind powered self-steering function in response to pivotal movements of a windvane, wherein windvane movements caused by sensing the apparent wind are effectively transmitted to the rudder at varying angles of tilt of the windvane axis without any appreciable variation in the ratio of rudder response to windvane motion. The device also enables a desired wind-ship angle of the windvane to be quickly established in the trailing mode, following which the self-steering device can be quickly shifted to the steering mode to maintain the windship relationship so established. The device is also relatively uncomplicated in construction, so as to be simple and inexpensive to manufacture, and can be easily mounted or demounted upon existing sailing vessels with very little effort. Wind sensitivity and course adjustments can also be easily and rapidly made from a central location, such as the cockpit of a sailing vessel, thus facilitating practical everyday use of the system.

Although described with reference to a preferred embodiment, many variations in the specific structure and in application of the system of the invention will suggest themselves to those skilled in the art to which the invention pertains, without departing from the spirit and scope of the invention. Thus, one detail illustrated but not previously specificially described relates to the counterbalancing of the windvane 24 by a suitable counterweight, for example, as represented at 180 in FIGS. 1 and 3; also to counterweighting of the crank mechanisms for translating pivotal motions into linear motions, for example, as represented by the counterweight 182 in FIG. 3. Assuming appropriate care to retain the advantages of the concept disclosed, substantially different mechanical systems for translating pivotal or rotary motions into linear motions, or for changing the direction of linear motions, might be employed in carrying out the invention without alteration in the basic concept. The same is true as respects the translation of linear motions of the output shaft 28 into pivotal movements of the trim tab 30. These and other variations are clearly within the scope of the invention disclosed herein, which is not intended to be limited to the specific embodiment herein illustrated and described.

What is claimed is:

1. In a wind powered self-steering device for sail boats of the type employing a steering rudder and trim tab, a base unit attached to the sail boat, a vane unit mounted for pivotal movements about a vertical axis as respects said base unit, an output shaft mounted for linear movement as respects said base unit, vane support means mounted for pivotal movements about a horizontal pivot axis carried by said vane support unit, vane means including a vane pivot axis carried by said vane support means, said vane pivot axis being perpendicular to the horizontal pivot axis of said vane support means, means to pivot said vane support means to obtain varying angles of tilt of said vane pivot axis between substantially vertical and horizontal positions as respects said base unit, means operable at all angles of tilt of said vane pivot axis to translate pivotal movements of said vane means about said vane pivot axis to linear movements of said output shaft at a substantially constant ratio of linear response to pivotal motion, and means to translate the linear movements of said output shaft into pivotal steering movements of said trim tab, whereby said vane means can be set at a desire steering angle for course and at a desired tilt angle for sea and weather, and thereafter operated to positively translate all wind forces produced by the sail boat being off course into corrective movements of said trim tab and rudder to return the sail boat to course.

2. A self-steering device as in claim 1 wherein said means to translate the pivotal movements of said vane means into linear movements of said output shaft means is cooperatively mounted to tilt with said vane pivot axis, thereby to insure positive steering corrections at all angles of tilt of said vane pivot axis.

3. A self-steering device as in claim 2 wherein said means to translate pivotal movements of said vane means to linear movements of said output shaft means includes pinion gear means on said vane pivot axis, cooperating rack gear means on the horizontal pivot axis of said vane support means, and means transmitting linear movements of said rack gear to said output shaft means.

4. A self-steering device as in claim 1 including control means operable in one position to prevent pivotal steering movements of said vane means while freeing said vane unit for trailing pivotal movements with respect to said base unit to establish a desired steering position, and operable in another position to maintain said steering position of the vane unit with respect to said base unit while freeing said vane means for corrective pivotal movements about said vane pivot axis to maintain said steering position.

5. A wind powered self-steering device for sail boats of the type employing a steering rudder and trim tab, comprising: a base unit attached to the sail boat, a vane unit mounted for rotatable movement about a vertical axis as respects said base unit, an output shaft mounted for linear movements substantially coincident with said vertical axis, vane support means mounted for pivotal movements about a horizontal pivot axis carried by said vane support unit, vane means including a vane pivot axis carried by said vane support means, said vane pivot axis being perpendicular to the horizontal pivot axis of said vane support means whereby said vane means is rotatable about said vane pivot axis and tiltable about said horizontal pivot axis, means to pivot said vane suppport means to obtain varying angles of tilt of said pivot axis between substantially vertical and horizontal positions as respects said base vane unit, means operable at all angles of tilt of said vane pivot axis to translate pivotal movements of said vane means about said vane pivot axis into linear movements of said output shaft at a substantially constant ratio of linear response to pivotal movement, means to translate the linear movements of said output shaft into pivotal steering movements of said trim tab, and control means for said vane means and vane unit, said control means being operable in a first position to lock said vane means against pivotal steering movements while freeing said vane unit for trailing pivotal movements with respect to said base unit to thereby establish a desired steering position for course, said control means being operable in a second position to lock said vane unit with respect to said base unit to maintain said course position while freeing said vane means for pivotal steering movements about said vane pivot axis, whereby in said course position said vane means is operable at any desired tilt position of said vane pivot axis to positively translate wind forces produced by the sailboat being off course into corrective movements of said trim tab and rudder to return the sail boat to course.

6. A self-steering device as in claim 5 including means to adjust the sensitivity of the vane means to the relative wind force available for self-steering corrections, said means including external means to pivotally adjust said vane support means with respect to said horizontal pivot axis to obtain a desired tilt angle of said vane pivot axis.

7. A self-steering device as in claim 5 including external course adjustment means operable in said second position of the control means to rotatably adjust the course position of said vane unit with respect to said base unit.

8. A self-steering device as in claim 5 wherein said control means for the vane means and vane unit includes alternately operable engagement means, one of which engages the vane unit to prevent rotation thereof with respect to said base unit, the other of which engages said output shaft to prevent linear movements thereof.

9. A self-steering device as in claim 8 wherein said alternately operable engagement means are carried on a slide mount within the base unit and external control means are provided to slidably engage one engagement means while disengaging the other.

10. A self-steering device as in claim 8 wherein said engaging means to prevent rotation of said vane unit includes additional means to adjust the course position of said vane unit as respects said base unit.

* * * * *